US011671745B2

(12) United States Patent
Wilk et al.

(10) Patent No.: US 11,671,745 B2
(45) Date of Patent: Jun. 6, 2023

(54) HEADPHONE EARCUP WITH ADSORPTIVE MATERIAL

(71) Applicant: Apple Inc., Cupertino, CA (US)

(72) Inventors: Christopher Wilk, Los Gatos, CA (US); Jarrett B. Lagler, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 17/230,792

(22) Filed: Apr. 14, 2021

(65) Prior Publication Data

US 2022/0086561 A1 Mar. 17, 2022

Related U.S. Application Data

(60) Provisional application No. 63/079,389, filed on Sep. 16, 2020.

(51) Int. Cl.

| | |
|---|---|
| ***H04R 1/28*** | (2006.01) |
| ***H04R 5/033*** | (2006.01) |
| ***H04R 1/10*** | (2006.01) |

(52) U.S. Cl.

CPC ..... *H04R 1/2811* (2013.01); *H04R 1/1008* (2013.01); *H04R 1/1058* (2013.01); *H04R 1/1083* (2013.01); *H04R 1/2803* (2013.01); *H04R 1/288* (2013.01); *H04R 5/0335* (2013.01); *H04R 2201/029* (2013.01)

(58) Field of Classification Search

CPC ..... H04R 1/1008; H04R 1/28; H04R 1/2803; H04R 1/288; H04R 1/2811; H04R 1/2849; H04R 1/2876; H04R 5/023; H04R 5/0335; H04R 2201/029; H04R 2201/105; H04R 1/1058; H04R 1/1083

See application file for complete search history.

(56) References Cited

U.S. PATENT DOCUMENTS

| | | | | |
|---|---|---|---|---|
| 4,856,118 | A * | 8/1989 | Sapiejewski | A61F 11/14 381/372 |
| 8,374,373 | B2 * | 2/2013 | Sapiejewski | H04R 1/1008 381/372 |
| 9,407,977 | B2 | 8/2016 | Papakyriacou et al. | |
| 9,615,165 | B2 * | 4/2017 | Herold | H04R 1/2811 |
| 9,635,455 | B2 * | 4/2017 | Schöffmann | H04R 1/288 |
| 10,080,077 | B2 * | 9/2018 | Silvestri | H04R 1/1083 |
| 10,349,167 | B2 | 7/2019 | Wilk et al. | |

(Continued)

FOREIGN PATENT DOCUMENTS

| | | |
|---|---|---|
| CN | 103024624 B | 9/2015 |
| CN | 105872880 A | 8/2016 |

(Continued)

OTHER PUBLICATIONS

Yuan et al., "Sound image externalization for headphone based real-time 3D audio", Jun. 21, 2017, Frontiers of Computer Science, vol. 11, No. 3, pp. 419-428.

*Primary Examiner* — Huyen D Le

(74) *Attorney, Agent, or Firm* — Aikin & Gallant, LLP

(57) ABSTRACT

A headphone earcup comprising: a frame defining an acoustic cavity that is acoustically coupled to a driver; an earcup cushion coupled to the frame and surrounding the acoustic cavity; and an adsorbent member acoustically coupled to the acoustic cavity to cause an acoustic enlargement of the acoustic cavity.

25 Claims, 4 Drawing Sheets

(56) References Cited

U.S. PATENT DOCUMENTS

| | | | | |
|---|---|---|---|---|
| 2011/0007928 | A1* | 1/2011 | Chang | H04R 1/1075 381/378 |
| 2011/0216909 | A1* | 9/2011 | Sapiejewski | H04R 1/1083 381/371 |
| 2016/0345090 | A1* | 11/2016 | Wilk | B01D 53/04 |
| 2019/0149904 | A1* | 5/2019 | England | H04R 1/1008 381/371 |

FOREIGN PATENT DOCUMENTS

| | | | |
|---|---|---|---|
| CN | 205726279 | U | 11/2016 |
| CN | 207926857 | U | 9/2018 |
| CN | 105163231 | B | 4/2019 |

* cited by examiner

HEADPHONE EARCUP WITH ADSORPTIVE MATERIAL

CROSS-REFERENCE TO RELATED APPLICATION

The application is a non-provisional application of co-pending U.S. Provisional Patent Application No. 63/079,389, filed Sep. 16, 2020 and incorporated herein by reference.

FIELD

An aspect of the disclosure is directed to a headphone earcup, more specifically a headphone earcup having an adsorptive material to acoustically enlarge an acoustic cavity of the earcup. Other aspects are also described and claimed.

BACKGROUND

Whether listening to a portable media player while traveling, or to a stereo or theater system at home, consumers often choose headphones. Headphones typically include a pair of earcups which encircle the user's ears and are held together by a headband. Headphones can be classified into two general categories based on the design of the earcups, namely closed-back or open-back earcups. Closed-back earcups surround the user's ears and have a sealed back. Open-back earcups also surround the user's ears but have a back which is open to the ambient environment surrounding the earcup.

Both the closed-back and the open-back designs have their own acoustic advantages and disadvantages. For example, closed-back earcups may have good sound isolation since they are sealed off from ambient noise. In addition, the size and clamp force of the earcups may also be modified to further increase sound isolation. Features of the closed-back design, such as the sealed back, size and clamp force of the earcups allow this design to mechanically or passively attenuate ambient noise. Due to the closed design of closed-back earcups, however, they may have stronger resonances. For example, standing waves can accumulate in the earcups. These standing waves can degrade sound quality and reduce the feeling of openness, which is often desired by a user. Open-back earcups, on the other hand, may feel more open to the user but may not be ideal in noisy environments because their passive attenuation may not be as good as closed-back designs.

SUMMARY

An aspect of the disclosure may include a headphone earcup that includes an adsorptive material to acoustically enlarge the acoustic cavity (e.g., front volume chamber) of the earcup. The acoustic cavity may be the cavity that receives sound output from an associated driver and surrounds the ear of the user. For example, the adsorptive material may be incorporated into the earcup and coupled to the acoustic cavity to simulate a larger acoustic cavity (e.g., larger front volume chamber) and/or maximize damping properties of the acoustic cavity. The acoustic enlargement and/or damping may, in turn, improve downlink response and passive attenuation at high frequencies. The adsorptive material may be any adsorptive material capable of providing damping without taking up as much space as other damping materials (e.g., foam). For example, the adsorptive material may be any adsorptive material capable of adsorbing gas during sound generation. In some aspects, the adsorptive material may be embedded into the earcup cushion (e.g., the ring of material surrounding the user's ear) or integrated into the earcup frame. For example, the adsorptive material may be integrated into the foam within the earcup cushion. The adsorptive material may include, or otherwise be part of, a module that is externally assembled and is inserted into the earcup frame. For example, the adsorbent material may be contained within a module housing having at least one opening to the acoustic cavity. For example, the module could be a module housing having rigid or acoustically non-transparent side walls (e.g., plastic side walls) and at least one acoustically transparent wall (e.g., a mesh side wall) that provides the opening to the acoustic cavity. In another aspect, the module could be a flexible enclosure, for example an enclosure made from an acoustically transparent fabric within which the adsorbent material may be contained and compressed to the desired size/shape. In some aspects, the adsorptive material acts as a tuning knob by increasing the acoustic cavity (e.g., the front volume chamber) and damping properties, which will have implications for passive attenuation. The adsorbent material may be any type of adsorbent material that can cause a simulated acoustic enlargement of the acoustic volume or cavity it is coupled to. In some aspects, the adsorptive material may include adsorptive particles that adsorb gas during sound generation. For example, the adsorbent material may include, but is not limited to, a microporous material such as zeolite. Zeolites are microporous minerals, usually aluminosilicate minerals. For example, the adsorptive material may include unbound particles, such as a granular composition of one or more of a zeolite material and/or an activated carbon material. In still further examples, the adsorptive material may be a zeolite material including zeolite particles having a particular silicon to aluminum mass ratio.

Representatively, in one aspect, a headphone includes two headphone earcups, each including a frame defining a driver front volume chamber; and an adsorbent member comprising zeolite that is acoustically coupled to the driver front volume chamber to cause an acoustic enlargement of the driver front volume chamber. The headphone may further include an earcup cushion coupled to the frame and surrounding the driver front volume chamber. The adsorbent member may be positioned within the earcup cushion. The earcup cushion may define an opening coupling the adsorbent member to the driver front volume chamber. In some aspects, the earcup cushion may include a foam and the adsorbent member may be integrated into the foam. The adsorbent member may be positioned inside the frame and the frame comprises an opening to acoustically couple the adsorbent member to the driver front volume chamber. The adsorbent member may include an adsorbent material that is encased within a housing coupled to the frame or an earcup cushion coupled to the frame. The housing may include a number of acoustically non-transparent side walls and at least one acoustically transparent side wall to acoustically couple the adsorbent material to the driver front volume chamber. The housing may include an acoustically transparent mesh. The adsorbent member may include a first adsorbent member coupled to the frame and a second adsorbent member coupled to an earcup cushion coupled to the frame.

In another aspect, a headphone earcup includes a frame defining an acoustic cavity that is acoustically coupled to a sound output side of a driver; an earcup cushion coupled to the frame and dimensioned to surround the acoustic cavity; and an acoustically adsorbent module comprising zeolite that is acoustically coupled to the acoustic cavity. The zeolite may be encased within a module housing. The module housing may include an acoustically transparent mesh material that encloses the zeolite. The module housing may be formed, in part, by an acoustically transparent fabric. The module housing may compress the zeolite into a smaller volume than if the zeolite were not encased within the module housing. The module housing may include at least one plastic sidewall that defines an opening to the zeolite. The acoustically adsorbent module may be positioned within the earcup cushion. The acoustically adsorbent module may be integrated into the frame. The acoustically adsorbent module may be separately formed from the frame and earcup cushion. The zeolite may cause a simulated acoustic enlargement of the acoustic cavity and dampen standing waves within the acoustic cavity.

The above summary does not include an exhaustive list of all aspects of the present disclosure. It is contemplated that the disclosure includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The aspects are illustrated by way of example and not by way of limitation in the figures of the accompanying drawings in which like references indicate similar elements. It should be noted that references to "an" or "one" aspect in this disclosure are not necessarily to the same aspect, and they mean at least one.

DETAILED DESCRIPTION

In the following description, numerous specific details are set forth. However, it is understood that aspects of the disclosure may be practiced without these specific details. In other instances, well-known circuits, structures and techniques have not been shown in detail in order not to obscure the understanding of this description.

In the following description, reference is made to the accompanying drawings, which illustrate several aspects of the present disclosure. It is understood that other aspects may be utilized, and mechanical compositional, structural, electrical, and operational changes may be made without departing from the spirit and scope of the present disclosure. The following detailed description is not to be taken in a limiting sense, and the scope of the aspects of the present disclosure is defined only by the claims of the issued patent.

The terminology used herein is for the purpose of describing particular aspects only and is not intended to be limiting of the disclosure. Spatially relative terms, such as "beneath", "below", "lower", "above", "upper", and the like may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (e.g., rotated 90 degrees or at other orientations) and the spatially relative descriptors used herein interpreted accordingly.

As used herein, the singular forms "a", "an", and "the" are intended to include the plural forms as well, unless the context indicates otherwise. It will be further understood that the terms "comprises" and/or "comprising" specify the presence of stated features, steps, operations, elements, and/or components, but do not preclude the presence or addition of one or more other features, steps, operations, elements, components, and/or groups thereof.

The terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

Figure 1:
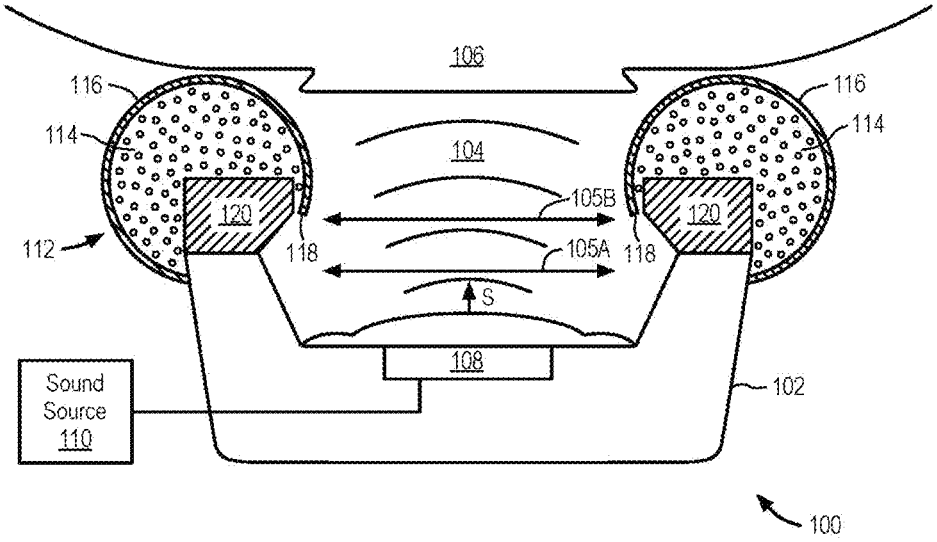
FIG. 1 illustrates a schematic diagram of a cross-sectional view of one aspect of a headphone earcup structure.

FIG. 1 illustrates a schematic diagram of a cross-sectional view of one aspect of a headphone earcup structure. It should be understood that the figures illustrate only one of a pair of left and right ear earcups of headphone 100, which can be connected by a head band (not shown). Thus, each of the features described in reference to the earcup of headphone 100 illustrated in FIG. 1 should be understood as applying to the other earcup of headphone 100. The earcup of headphone 100 includes a frame 102 that forms an enclosure dimensioned to encircle and form an acoustic cavity 104 around a user's ear 106. Acoustic cavity 104 may surround the ear 106 when the earcup of headphone 100 is positioned on the user's head, however, may be open to the ambient environment when not positioned against the user's head.

A driver 108 for outputting sound (S) (e.g., a music signal) in a direction of ear 106 may be mounted to frame 102. For example, the driver 108 may have a sound output side that is open to acoustic cavity 104 such that the sound (S) is output to the acoustic cavity 104. Acoustic cavity 104 may therefore also be considered a front volume chamber, or forming part of the front volume chamber, of the driver 108 since it opens to the ambient environment. Driver 108 may be any type of electric-to-acoustic transducer having a pressure sensitive diaphragm and circuitry configured to produce a sound in response to an electrical audio signal input (e.g., a loudspeaker). The electrical audio signal may be a music signal input to driver 108 by sound source 110. Sound source 110 may be any type of audio device capable of outputting an audio signal, for example, an audio electronic device such as a smartphone, a portable music player, home stereo system or home theater system capable of outputting an audio signal.

The earcup of headphone 100 may further include an earcup pad or cushion 112. The earcup cushion 112 may be attached to a side or face of frame 102 facing the ear 106 and forming the acoustic cavity 104. In some cases, the earcup cushion 112 may form part of the acoustic cavity 104 and help to form a seal between the acoustic cavity 104 and the user's ear 106. The earcup cushion 112 may be a donut or otherwise similarly circular, race track or elliptical shaped structure that encircles the acoustic cavity 104 and can seal around, or to, the head or ear 106 of the user. The earcup cushion 112 may be compressible and conform to the head and/or ear 106 of the user when pressed against the user's head and/or ear to improve user comfort. For example, the earcup cushion 112 may be made of a compressible foam material 114 that is contained within a cushion cover 116. In some aspects, the earcup cushion 112 may further include an opening 118 through the cover 116 so that the foam material 114 is acoustically open to the acoustic cavity 104. In this aspect, the foam material 114 may help to dampen standing waves within acoustic cavity 104. For example, as illustrated in FIG. 1, as the sound (S) is output by driver 108 upward (or otherwise away from the driver), the waves also propagate outward and cause standing waves 105A, 105B within different regions of the acoustic cavity 104. For example, there may be standing waves 105A within the portion of the cavity defined by the rigid frame 102 and standing waves 105B within the portion of the cavity defined by the flexible earcup cushion 112. The foam material 114 within the earcup cushion 112 may help to dampen the standing waves 105B.

The earcup headphone 100 may also include an adsorbent member 120 coupled to the acoustic cavity 104 to dampen the standing waves and cause a simulated acoustic enlargement of the acoustic cavity 104. In other words, the adsorbent member 120 may cause the volume of acoustic cavity 104 to seem larger than it actually is, which may, in turn, improve acoustic performance. As previously discussed, acoustic cavity 104 may form, or be part of, the driver front volume chamber, and therefore its size may impact an overall acoustic performance of the earcup. For example, maximizing the volume of acoustic cavity 104 may improve acoustic performance and enhance the user experience and/or comfort. Increasing the cavity volume of the earcup, however, is often challenging because it may also be desirable to maintain a relatively low profile, and in turn, compact footprint so the headphones are not too bulky. The adsorbent member 120 can therefore simulate an acoustic enlargement of the volume of acoustic cavity 104 without impacting the overall footprint and/or size of the headphone earcup. In this aspect, the adsorbent member 120 may include an adsorbent material that may have damping properties and occupy minimal space within the earcup. For example, the adsorbent material may include, but is not limited to, a zeolite material, or a combination of adsorptive materials, including activated carbon and zeolite materials. The adsorbent member 120 may, for example, occupy less space or volume than the foam material 114 while still providing damping properties and simulating an acoustic enlargement of the cavity 104.

In one aspect, adsorbent member 120 may be positioned within the earcup cushion 112. In this position, adsorbent member 120 may help to dampen the standing waves 105B within the cushion region of the cavity 104. Representatively, adsorbent member 120 may be incorporated into the foam material 120 of earcup cushion 112. For example, adsorbent member 120 may be positioned within a portion of the foam material 114 that is proximal to the opening 118 of earcup cushion 112 so that it is exposed to acoustic cavity 104. Representatively, adsorbent member 120 could be an adsorbent material (e.g., zeolite) embedded within the foam material 120. In further aspects, the adsorbent member 120 could include a module that encases the adsorbent material and the module may be embedded or encased within the foam material 120. For example, the module with the adsorbent material encased therein could be mounted (or otherwise attached) to the end of the frame 102 to which the earcup cushion 112 is also attached. Loading the module or portion of the foam material with the adsorbent material may involve injecting the adsorbent material (and in some cases in combination with an adhesive material) directly into the module or foam material, or a mold to achieve a preformed shape which is then loaded into the desired mold or material within cushion 112. Adsorbent member 120 is then positioned within the foam material 114 inside the cushion cover 116. Although adsorbent member 120 is shown attached to the end of frame 102, it should be understood that adsorbent member 120 may be attached to any portion of earcup cushion 112 or frame 102 that acoustically couples it to the acoustic cavity 104. In addition, adsorbent member 120 could be a ring shaped member extending entirely around the earcup cushion 112, or formed as discrete units positioned within portions of earcup cushion 112 surrounding the cavity 104. Representative module configurations for the adsorbent member 120 will be described in more detail in reference to FIG. 3-FIG. 4.

Figure 2:
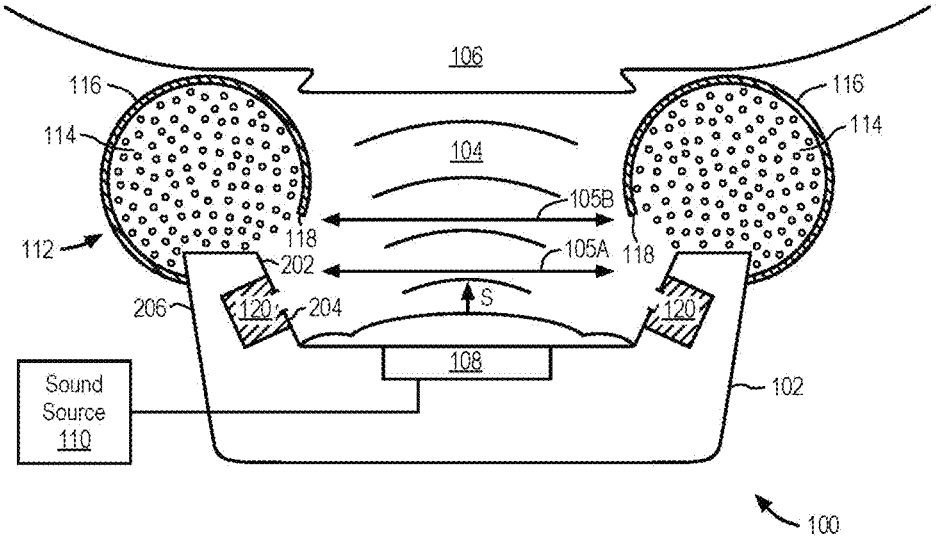
FIG. 2 illustrates a schematic diagram of a cross-sectional view of one aspect of a headphone earcup structure.

Referring now to FIG. 2, FIG. 2 illustrates another aspect in which adsorbent member 120 is attached to the headphone earcup 100. In this aspect, adsorbent member 120 is shown attached or otherwise mounted to a portion of frame 102. Representatively, adsorbent member 120 may be attached to a side wall 202 of frame 102 that defines a portion of acoustic cavity 104. For example, the adsorbent member 120 may be attached to interior side wall 202 (e.g., a side wall that defines the cavity 104). In some aspects, adsorbent member 120 is positioned inside the frame 102, between the interior side wall 202 and exterior side wall 206 defining frame 102, as shown. In this aspect, adsorbent member 120 does not occupy, or otherwise reduce the usable volume of, the acoustic cavity 104. The frame side wall 202 may include an opening 204 to the adsorbent member 120 so that it is acoustically open to the acoustic cavity 104.

When positioned in the frame 102 as shown in FIG. 2, adsorbent member 120 may help to dampen the standing waves 105A that occur within this region of cavity 104 and cause a simulated acoustic enlargement of the acoustic cavity 104. Although adsorbent member 120 is shown attached to the side wall 202, it should be understood that adsorbent member 120 may be attached to any side wall or portion of frame 102 that acoustically couples it to the acoustic cavity 104. In addition, adsorbent member 120 may extend entirely around frame 102 (e.g., a ring shaped structure) or it could be made up of discrete units positioned within portions of frame 102. Still further, it should be understood that any number of adsorbent members 120 may be used within the earcup housing 100. For example, earcup housing 100 may include both adsorbent member 120 in the earcup cushion as shown in FIG. 1 and adsorbent member 120 in the frame as shown in FIG. 2.

Figure 3:
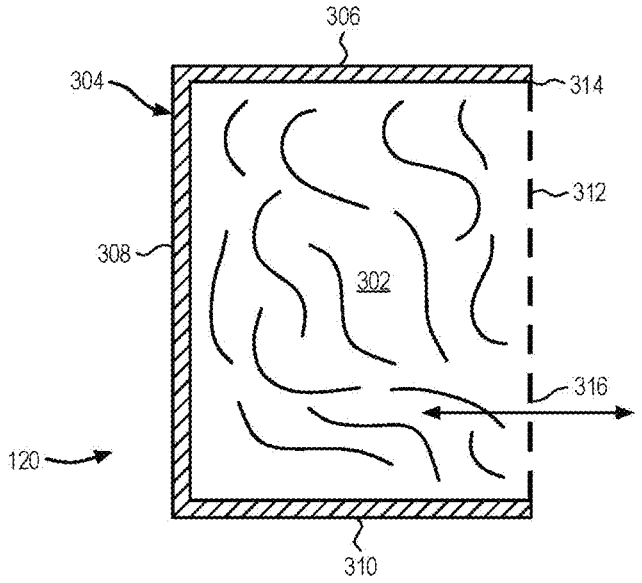
FIG. 3 illustrates a schematic diagram of a magnified cross-sectional view of an adsorbent member of the headphone earcup structure of FIG. 1.
Figure 4:
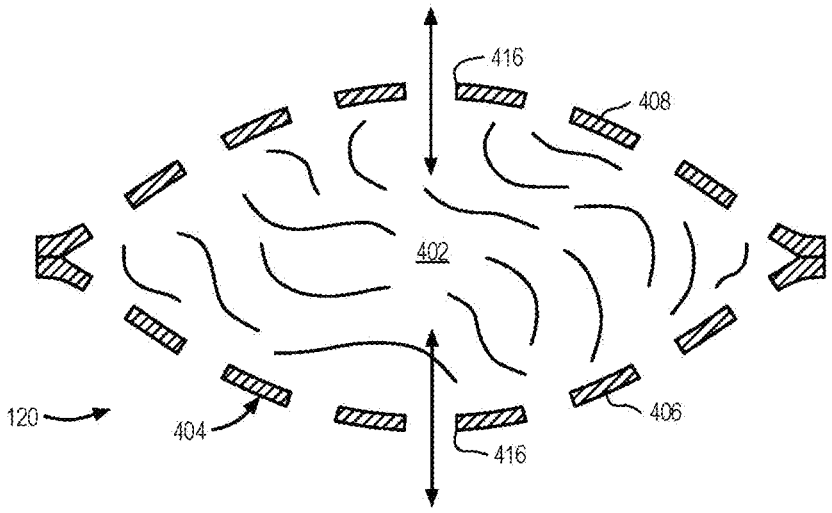
FIG. 4 illustrates a schematic diagram of a magnified cross-sectional view of an adsorbent member of the headphone earcup structure of FIG. 1.

Referring now to FIGS. 3-4, FIGS. 3-4 illustrate cross-sectional views of representative adsorbent members that could be integrated into headphone earcup 100. FIG. 3 illustrates an adsorbent member 120 in which the adsorbent material 302 is encased within a module enclosure or housing 304. The module enclosure or housing 304 may include a number of side walls 306, 308, 310, 312 that encase or otherwise contain the adsorbent material 302. For example, housing 304 may include a number of relatively rigid and/or non-acoustically transparent side walls 306-310 and at least one acoustically transparent side wall 312. The acoustically transparent side wall 312 may be positioned over the opening 314 defined by the side walls 306 and 310. The acoustically transparent side wall 312 includes openings 316 so that the adsorbent material 302 is open to the acoustic cavity and can cause an acoustic enlargement, as previously discussed. For example, the acoustically transparent side wall may be made of a fabric, mesh or other similar material having openings to allow for acoustic transmission between the acoustic cavity and the adsorbent material 302.

Referring now to FIG. 4, FIG. 4 illustrates another aspect of an adsorbent member that could be integrated into the headphone earcup 100. Representatively, adsorbent member 120 may include adsorbent material 402 encased or otherwise contained within a module enclosure or housing 404. Enclosure or housing 404 may include side walls 406, 408 similar to the module previously discussed in reference to FIG. 3. In this aspect, however, side walls 406 and 408 may be made of a relatively flexible, acoustically transparent material including openings 416 so that they allow for acoustic transmission between the adsorbent material 402 encased therein and the acoustic cavity, as previously discussed. For example, side walls 406, 408 may be made of sheets of an acoustically transparent fabric or mesh material that are attached together around their edges so that adsorbent material 402 is entirely encased between side walls 406, 408. In some aspect, adsorbent material 402 may be compressed or otherwise shaped as desired so that adsorbent member 120 occupies minimal space within the earcup.

Any of the previously discussed module enclosures or housings 304, 404 may be integrated into the earcup headphone 100 previously discussed in reference to FIG. 1-FIG. 2. Representatively, in some aspects, the module enclosures or housings 304, 404 may be separately formed from the headphone earcup 100 and then attached to the frame 102 or earcup cushion 112 during assembly. In one aspect, the module may be mechanically attached to the headphone earcup 100. For example, one or more of the side walls of the module enclosures or housings 304, 404 may include an interlocking member that interlocks with the side wall of frame 102 so that the module attaches to frame 102 or earcup cushion 112 in a snap fit arrangement. In other aspects, the module enclosures or housings 304, 404 may be mounted to the frame 102 or earcup cushion 112 according to any other suitable fastening mechanism (e.g., molded, adhesives or the like).

Figure 5:
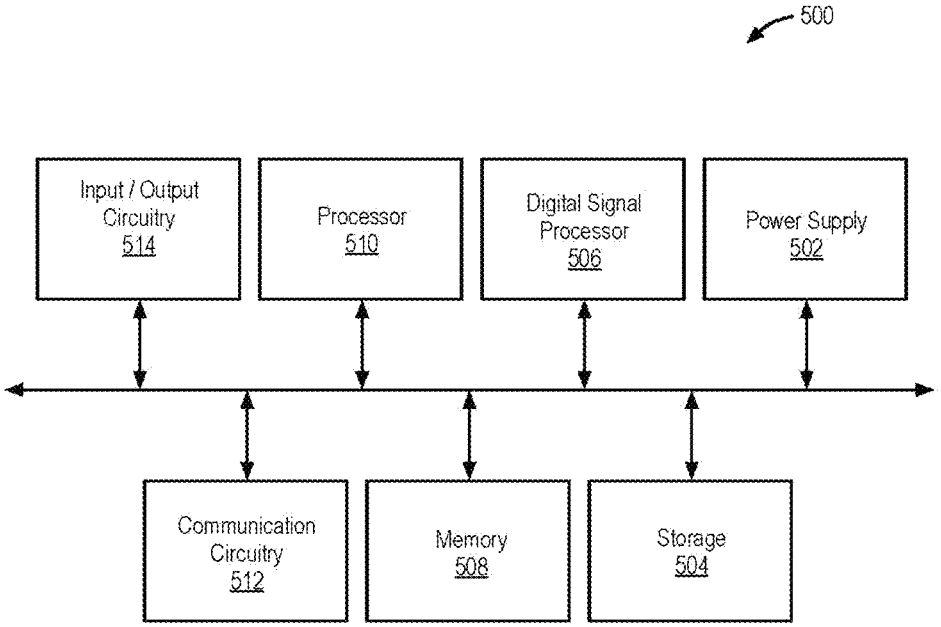
FIG. 5 illustrates a simplified schematic view of one aspect of an electronic device in which the headphone earcup structure may be implemented.

FIG. 5 illustrates a simplified schematic view of one aspect of an electronic device in which the headphone earcup disclosed herein may be implemented. For example, headphone 100 are examples of systems that can include some or all of the circuitry illustrated by electronic device 500. Electronic device 500 can include, for example, power supply 502, storage 504, signal processor 506, memory 508, processor 510, communication circuitry 512, and input/output circuitry 514. In some aspects, electronic device 500 can include more than one of each component of circuitry, but for the sake of simplicity, only one of each is shown in FIG. 5. In addition, one skilled in the art would appreciate that the functionality of certain components can be combined or omitted and that additional or less components, which are not shown in FIGS. 1-4, can be included in, for example, headphone 100.

Power supply 502 can provide power to the components of electronic device 500. In some aspects, power supply 502 can be coupled to a power grid such as, for example, a wall outlet. In some aspects, power supply 502 can include one or more batteries for providing power to a headphone or other type of electronic device associated with the headphone. As another example, power supply 502 can be configured to generate power from a natural source (e.g., solar power using solar cells).

Storage 504 can include, for example, a hard-drive, flash memory, cache, ROM, and/or RAM. Additionally, storage 504 can be local to and/or remote from electronic device 500. For example, storage 504 can include integrated storage medium, removable storage medium, storage space on a remote server, wireless storage medium, or any combination thereof. Furthermore, storage 504 can store data such as, for example, system data, user profile data, and any other relevant data.

Signal processor 506 can be, for example a digital signal processor, used for real-time processing of digital signals that are converted from analog signals by, for example, input/output circuitry 514. After processing of the digital signals has been completed, the digital signals could then be converted back into analog signals. For example, the signal processor 506 could be used to analyze digitized audio signals received from ambient or error microphones to determine how much of the audio signal is ambient noise or earcup noise and how much of the audio signal is, for example, music signals.

Memory 508 can include any form of temporary memory such as RAM, buffers, and/or cache. Memory 508 can also be used for storing data used to operate electronic device applications (e.g., operation system instructions).

In addition to signal processor 506, electronic device 500 can additionally contain general processor 510. Processor 510 can be capable of interpreting system instructions and processing data. For example, processor 510 can be capable of executing instructions or programs such as system applications, firmware applications, and/or any other application. Additionally, processor 510 has the capability to execute instructions in order to communicate with any or all of the components of electronic device 500. For example, processor 510 can execute instructions stored in memory 508 to enable or disable ANC, or instructions to open or close a passive control assembly valve.

Communication circuitry 512 may be any suitable communications circuitry operative to initiate a communications request, connect to a communications network, and/or to transmit communications data to one or more servers or devices within the communications network. For example, communications circuitry 512 may support one or more of Wi-Fi (e.g., a 802.11 protocol), Bluetooth®, high frequency systems, infrared, GSM, GSM plus EDGE, CDMA, or any other communication protocol and/or any combination thereof.

Input/output circuitry 514 can convert (and encode/decode, if necessary) analog signals and other signals (e.g., physical contact inputs, physical movements, analog audio signals, etc.) into digital data. Input/output circuitry 514 can also convert digital data into any other type of signal. The digital data can be provided to and received from processor 510, storage 504, memory 508, signal processor 506, or any other component of electronic device 500. Input/output circuitry 514 can be used to interface with any suitable input or output devices. Furthermore, electronic device 500 can include specialized input circuitry associated with input devices such as, for example, one or more proximity sensors, accelerometers, etc. Electronic device 500 can also include specialized output circuitry associated with output devices such as, for example, one or more speakers, earphones, etc.

Lastly, bus 516 can provide a data transfer path for transferring data to, from, or between processor 510, storage 504, memory 508, communications circuitry 512, and any other component included in electronic device 500. Although bus 516 is illustrated as a single component in FIG. 5, one skilled in the art would appreciate that electronic device 500 may include one or more components.

While certain aspects have been described and shown in the accompanying drawings, it is to be understood that such aspects are merely illustrative of and not restrictive on the broad disclosure, and that the disclosure is not limited to the specific constructions and arrangements shown and described, since various other modifications may occur to those of ordinary skill in the art. The description is thus to be regarded as illustrative instead of limiting. In addition, to aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

What is claimed is:

1. A headphone comprising:

two headphone earcups each comprising:

a rigid frame having an exterior wall and an interior wall defining a driver front volume chamber around a driver mounted thereto; and an adsorbent member comprising zeolite that is positioned within the frame between the exterior wall and the interior wall and acoustically coupled to the driver front volume chamber by an opening in the interior wall to cause an acoustic enlargement of the driver front volume chamber.

2. The headphone of claim 1 further comprising an earcup cushion coupled to the frame and surrounding the driver front volume chamber.

3. The headphone of claim 2 wherein the adsorbent member is a first adsorbent member, and a second adsorbent member is positioned within the earcup cushion.

4. The headphone of claim 3 wherein the earcup cushion defines an opening coupling the second adsorbent member to the driver front volume chamber.

5. The headphone of claim 1 further comprising an earcup cushion coupled to the frame and surrounding the driver front volume chamber, and wherein the earcup cushion comprises a foam and the adsorbent member is a first adsorbent member and a second adsorbent member is integrated into the foam.

6. The headphone of claim 1 wherein the adsorbent member comprises an adsorbent material positioned inside a housing and the housing comprises an interlocking member to couple the housing to the interior wall.

7. The headphone of claim 1 wherein the adsorbent member comprises an adsorbent material that is encased within a housing coupled to the frame.

8. The headphone of claim 7 wherein the housing comprises a number of non-acoustically transparent side walls and at least one acoustically transparent side wall to acoustically couple the adsorbent material to the driver front volume chamber.

9. The headphone of claim 7 wherein the housing comprises an acoustically transparent mesh.

10. A headphone earcup comprising:

a frame defining an acoustic cavity that is acoustically coupled to a sound output side of a driver;

an earcup cushion comprising a foam material coupled to the frame and dimensioned to surround the acoustic cavity; and an acoustically adsorbent module comprising side walls that encase a zeolite material and at least one opening that acoustically couples the encased zeolite material to the acoustic cavity.

11. The headphone earcup of claim 10 wherein the side walls separate the zeolite material from the foam material.

12. The headphone earcup of claim 11 wherein the side walls comprise an acoustically transparent mesh material that encloses the zeolite material.

13. The headphone earcup of claim 11 wherein the side walls are formed, in part, by an acoustically transparent fabric.

14. The headphone earcup of claim 13 wherein the acoustically transparent fabric compresses the zeolite material encased therein.

15. The headphone earcup of claim 11 wherein at least one of the side walls is a plastic sidewall that defines the opening to the zeolite material.

16. The headphone earcup of claim 10 wherein the acoustically adsorbent module is positioned within the earcup cushion.

17. The headphone earcup of claim 10 wherein the acoustically adsorbent module is integrated into the frame.

18. The headphone earcup of claim 10 wherein the acoustically adsorbent module is separately formed from the frame and earcup cushion.

19. The headphone earcup of claim 10 wherein the zeolite material causes a simulated acoustic enlargement of the acoustic cavity and dampens standing waves within the acoustic cavity.

20. A headphone comprising:

a frame defining an acoustic cavity that is acoustically coupled to a sound output side of a driver;

a cushion comprising a foam material coupled to the frame and dimensioned to surround the acoustic cavity; and an acoustically adsorbent module comprising side walls dimensioned to encase a zeolite material and the encased zeolite material is acoustically coupled to the acoustic cavity.

21. The headphone of claim 20 wherein the side walls separate the zeolite material from the foam material.

22. The headphone of claim 20 wherein the side walls comprise an acoustically transparent mesh or fabric material that encases the zeolite material.

23. The headphone of claim 20 wherein the side walls compress the zeolite material encased therein.

24. The headphone of claim 20 wherein at least one of the side walls is a plastic sidewall that defines an opening to the zeolite material.

25. The headphone of claim 20 wherein an earcup of the headphone comprises the frame, the cushion and the acoustically adsorbent module.

* * * * *